US006592065B1

(12) United States Patent
Tsou et al.

(10) Patent No.: US 6,592,065 B1
(45) Date of Patent: Jul. 15, 2003

(54) WINDING TYPE FLEXIBLE PRINTED CIRCUIT BOARD TAPE TRANSFERRING SYSTEM

(75) Inventors: Chia-Chun Tsou, Taipei (TW); Ying-Ming Hung, Hsintien (TW); Shi-Hau Yeh, Chung-Ho (TW); Shaw-Ren Leu, Panchiao (TW)

(73) Assignee: Utechzone Co., Ltd., Taipei Hsien (TW)

( * ) Notice: Subject to any disclaimer, the term of this patent is extended or adjusted under 35 U.S.C. 154(b) by 89 days.

(21) Appl. No.: 09/973,764

(22) Filed: Oct. 11, 2001

(51) Int. Cl.[7] ..... B65H 20/32

(52) U.S. Cl. ..... 242/417.3; 242/352.2; 242/357; 242/534.2

(58) Field of Search ..... 242/417.3, 333, 242/353, 352.2, 357, 534.2, 535.3, 538, 538.2

(56) References Cited

U.S. PATENT DOCUMENTS 2,854,197 A * 9/1958 MacNeill ..... 242/352.2
2,913,192 A * 11/1959 Mullin ..... 242/353
2,958,477 A * 11/1960 James et al. ..... 242/353
2,985,396 A * 5/1961 Johnson ..... 242/353
5,419,506 A * 5/1995 Gunday et al. ..... 242/417.3
5,825,374 A * 10/1998 Albertalli et al. ..... 242/417.3

* cited by examiner

*Primary Examiner*—William A. Rivera
(74) *Attorney, Agent, or Firm*—Varndell & Varndell, PLLC

(57) ABSTRACT

A winding type flexible printed circuit board tape transferring system includes tape let-off wheel unit, a tape take-up wheel unit, two idle wheel units adapted to guide movement of the flexible printed circuit board tape from the tape let-off wheel unit to the tape take-up wheel unit, a tension control wheel unit adapted to control the tension of the flexible printed circuit board tape being transferred from the tape let-off wheel unit to the tape take-up wheel unit, and at least one work wheel unit adapted to rotate a respective rotary encoder upon movement of the flexible printed circuit board tape, enabling the rotary encoder to output a signal to a control unit indicative of the position of the flexible printed circuit board tape.

3 Claims, 5 Drawing Sheets

WINDING TYPE FLEXIBLE PRINTED CIRCUIT BOARD TAPE TRANSFERRING SYSTEM

BACKGROUND AND SUMMARY OF THE INVENTION

The present invention relates to a printed circuit board tape transferring system, and more specifically, to winding type flexible printed circuit board tape transferring system, which is practical to transfer flexible printed circuit board of different types and widths.

Following fast development of telecommunication industry, semiconductor industry, and planer display industry, different thin-film tapes such as tape carried package, tape ball grid array, and chip on film are intensively used as tapes for printed circuit board. These flexible film tapes commonly have sprocket holes symmetrically arranged along the two opposite lateral sides for positioning in a transferring system. The thickness of these flexible film tapes is about 0.025~0.125 mm. The width of these flexible film tapes ranges from minimum 35 mm to maximum over 200 mm. When employing these flexible film tapes to the fabrication of flexible printed circuit board, several problems may be encountered as outlined hereinafter.

1. It is difficult to keep the coplanarity of the flexible film tape without any contacts at the region of circuits during the manufacturing process.
2. When transferring the flexible film tape, an improper control of the transmission mechanism may cause the transmission mechanism to damage or deform the sprocket holes of the flexible film tape.
3. A flexible film tape without sprocket holes is not transferable.
4. When running an examination operation, the transferring system must be break off, and then the examination apparatus is operated to examine one segment of the flexible film tape, and then the flexible film tape is carried forwards, and then the examination apparatus is returned to its former position for examining a next segment of the flexible film tape. This repeated transferring and examining procedure wastes much time.

The present invention has been accomplished to provide a winding type flexible printed circuit board tape transferring system, which eliminates the aforesaid drawbacks. It is one object of the present invention to provide a winding type flexible printed circuit board tape transferring system, which is practical to transfer flexible printed circuit board tapes of different widths. It is another object of the present invention to provide a winding type flexible printed circuit board tape transferring system, which is practical to transfer flexible printed circuit board tape having sprocket holes as well as flexible printed circuit board tapes without sprocket holes. It is still another object of the present invention to provide a winding type flexible printed circuit board tape transferring system, which keeps the flexible printed circuit board tape flattened transversely extended out when transferring it, preventing the flexible printed circuit board tape from wrinkling. According to one aspect of the present invention, the winding type flexible printed circuit board tape transferring system includes a tape let-off wheel unit controlled to let off a flexible printed circuit board tape for processing, a tape take-up wheel unit controlled to take up the flexible printed circuit board tape from the tape let-off wheel unit, two idle wheel units adapted to guide movement of the flexible printed circuit board tape from the tape let-off wheel unit to the tape take-up wheel unit, a tension control wheel unit adapted to control the tension of the flexible printed circuit board tape being transferred from the tape let-off wheel unit to the tape take-up wheel unit, and at least one work wheel unit adapted to rotate a respective rotary encoder upon movement of the flexible printed circuit board tape, enabling the rotary encoder to output a signal to a control unit indicative of the position of the flexible printed circuit board tape. According to another aspect of the present invention, the wheels of the tension control wheel unit, idle wheel units, and at least one work wheel unit each comprise a wheel axle, a fixed wheel blade fixedly fastened to the wheel axle, an adjustment wheel blade slidably mounted on the wheel axle in parallel to the fixed wheel blade and fixed in the desired position subject to the width of the flexible printed circuit board tape by a holding down screw. The fixed wheel blade and the adjustment wheel blade each have a shoulder adapted to support the flexible printed circuit board tape being transferred from the tape let-off wheel to the take-up wheel.

DETAILED DESCRIPTION OF THE PREFERRED EMBODIMENT

Figure 1:
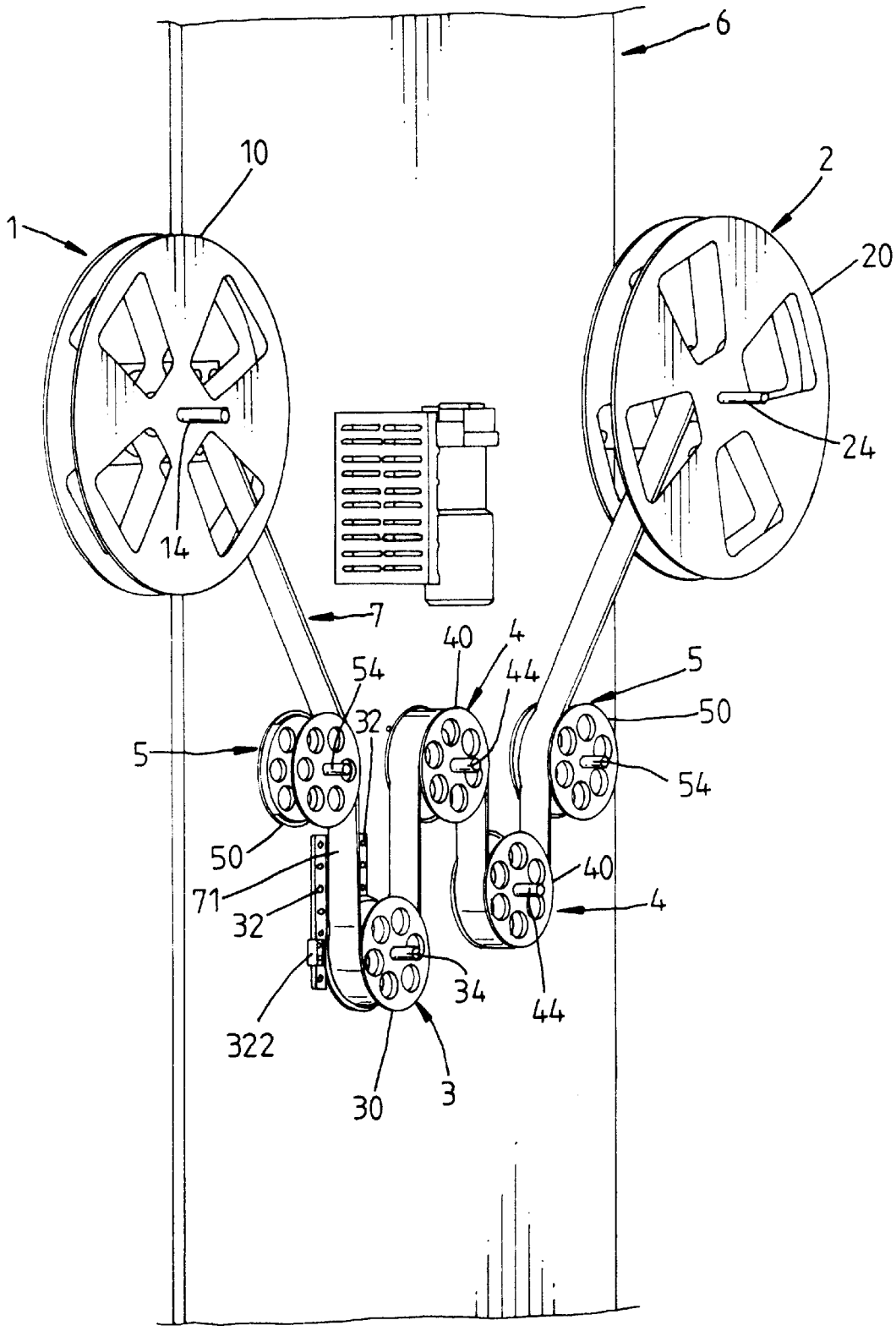
FIG. 1 is a perspective view of a winding type flexible printed circuit board tape transferring system according to the present invention.

Referring to FIG. 1, a winding type flexible printed circuit board tape transferring system in accordance with the present invention is shown comprised of a tape let-off unit 1, two idle wheel units 5, a tension control wheel unit 3, at least one, for example, two work wheel unit 4, a tape take-up wheel unit 2, and a rack 6.

Figure 5:
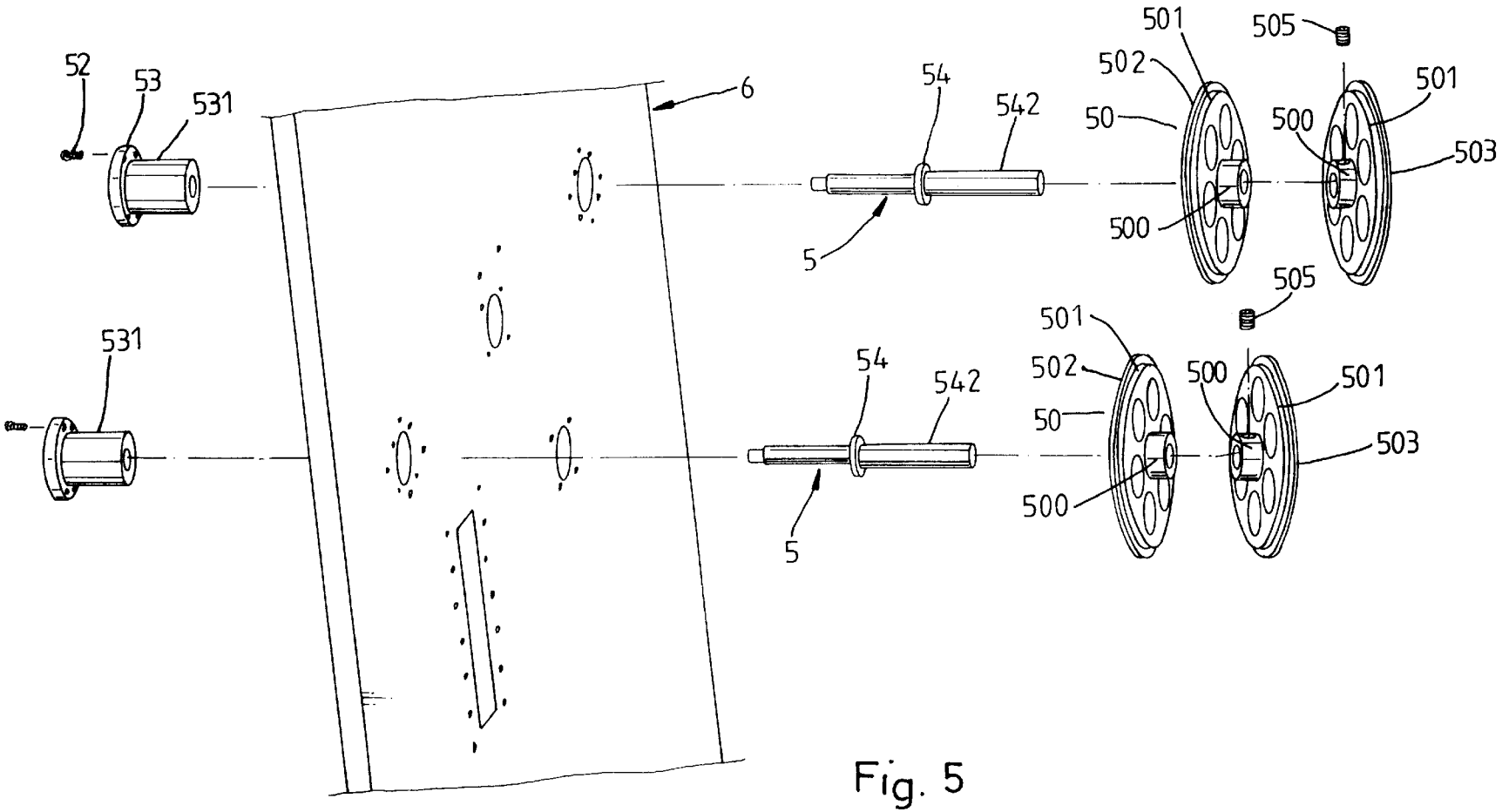
FIG. 5 is an exploded view in an enlarged scale of a part of the present invention, showing the arrangement of the idle wheel unit on the rack.

Referring to FIG. 5 and FIG. 1 again, the idle wheel units 5 are mounted on the rack 6 near two opposite lateral sides and adapted to guide the flexible film tape 7 from the let-off wheel 10 to the take-up wheel 20, each comprised of an axle bearing 53, a wheel axle 54, and an idle wheel 50. The axle bearing 53 is fixedly fastened to the rack 6 by fastening elements, for example, screws 52, having one side 531 extended through the rack 6. The wheel axle 54 is supported in the corresponding axle bearing 53, having one side 542 coupled to the corresponding idle wheel 50.

Figure 2:
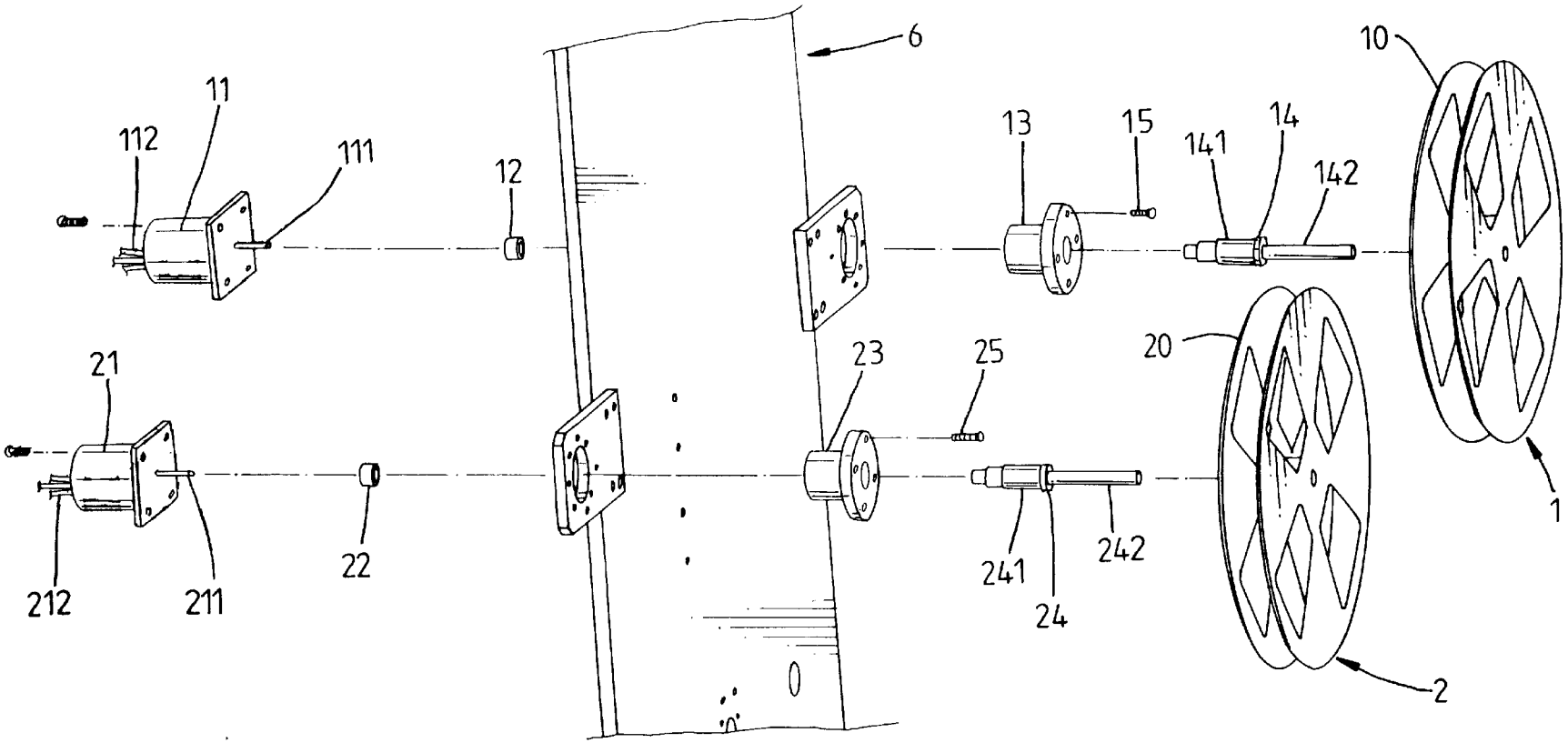
FIG. 2 is an exploded view in an enlarged scale of a part of the present invention, showing the arrangement of the tape let-off wheel unit and the tape take-up wheel unit on the rack.

Referring to FIG. 2 and FIG. 1 again, the tape let-off unit 1 comprises a motor 11, a coupling 12, an axle bearing 13, a wheel axle 14, and a let-off wheel 10. The motor 11 has an output shaft 111 adapted to rotate the wheel axle 14 and the let-off wheel 10, causing the let-off wheel 10 to let off the flexible film tape 7, and a power line 112 connected to the frequency transformer of the control unit (not shown), which controls the speed of the motor 11. The axle bearing 13 is fixedly fastened to the rack 6 by fastening elements, for example, screws 15. The wheel axle 14 has one end 141 inserted through the axle bearing 13 and then coupled to the output shaft 111 of the motor 11 by the coupling 12, and the other end 142 fastened to the let-off wheel 10.

Figure 3:
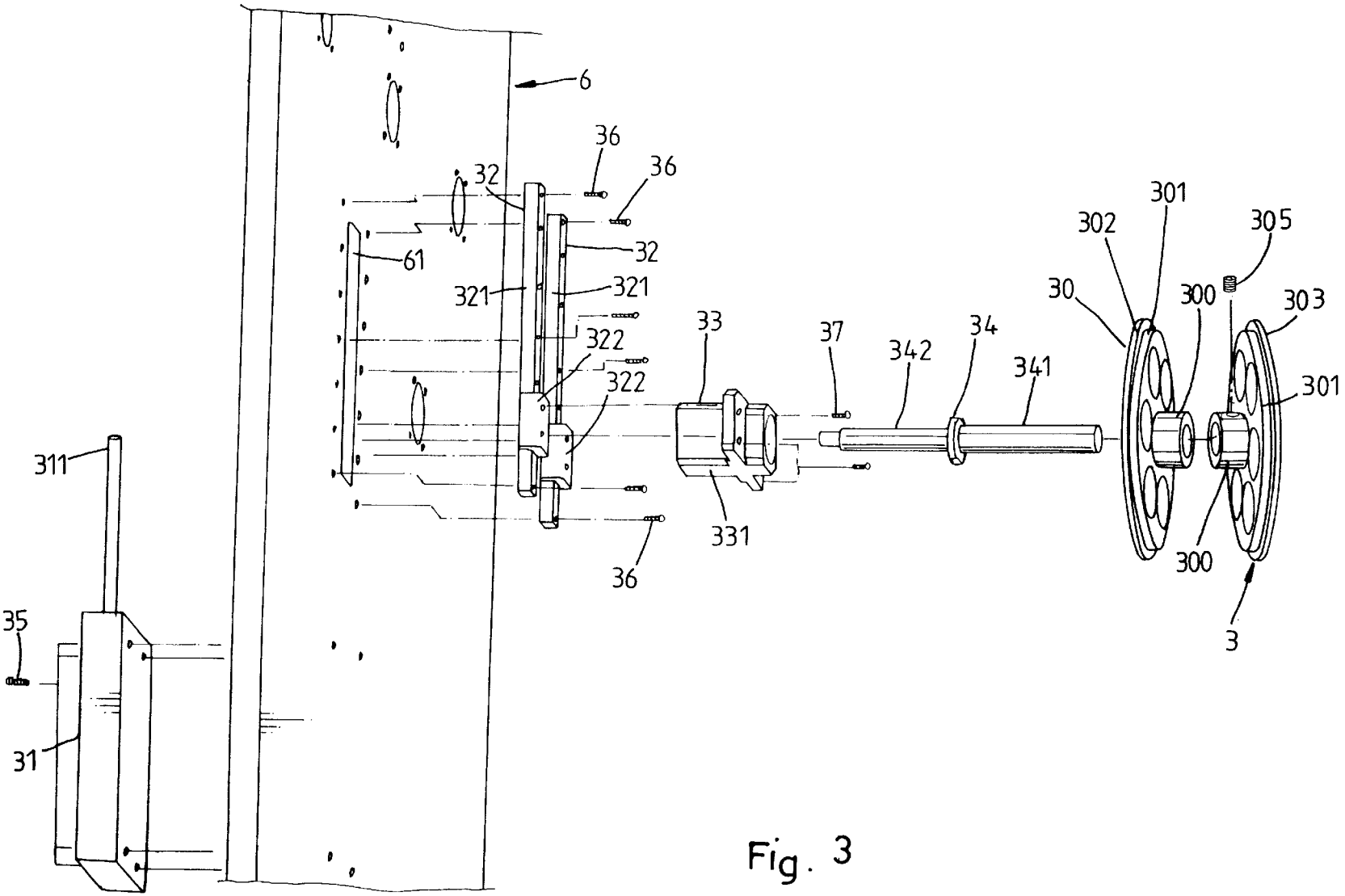
FIG. 3 is an exploded view in an enlarged scale of a part of the present invention, showing the arrangement of the tension control wheel unit on the rack.

Referring to FIG. 3 and FIG. 1 again, the tension control wheel unit 3 comprises a linear motor 31, a vertical track 32, an axle bearing 33, a wheel axle 34, and a tension wheel 30. The linear motor 31 is adapted to move the axle bearing 33 and the wheel axle 34 along the vertical track 32 to the desired elevation, causing the tension wheel 30 to control the tension of the flexible film tape 7 being delivered from the let-off wheel 10 to the take-up wheel 20. The position signal of the linear motor 31 is provided to the control unit for reference, enabling the control unit to control the speed of the tape let-off unit 1 and the tape take-up unit 2 properly. The linear motor 31 is fixedly fastened to the rack 6 by fastening elements, for example, screws 35. The vertical track 32 comprises two parallel rails 321 fixedly fastened to the rack 6 along two long sides of the longitudinal sliding slot 61 in the rack 6 by fastening elements, for example, screws 36, and two slides 322 respectively slidably coupled to the rails 321. The axle bearing 33 is fixedly fastened to the slides 322 by fastening elements, for example, screws 37, having a rear side 331 inserted through the longitudinal sliding slot 61 of the rack 6 and coupled to the reciprocating shaft 311 of the linear motor 31. The wheel axle 34 has one end 342 coupled to the axle bearing 33, and the other end 341 coupled to the tension wheel 30. When starting the motor 31 to move the reciprocating shaft 311 forwards (upwards) or backwards (downwards), the axle bearing 33 is moved with the reciprocating shaft 311 upwards or downwards along the longitudinal sliding slot 61, and therefore the tension wheel 30 and the wheel axle 34 are moved with the axle bearing 33 to adjust the tension of the flexible film tape 7.

Figure 4:
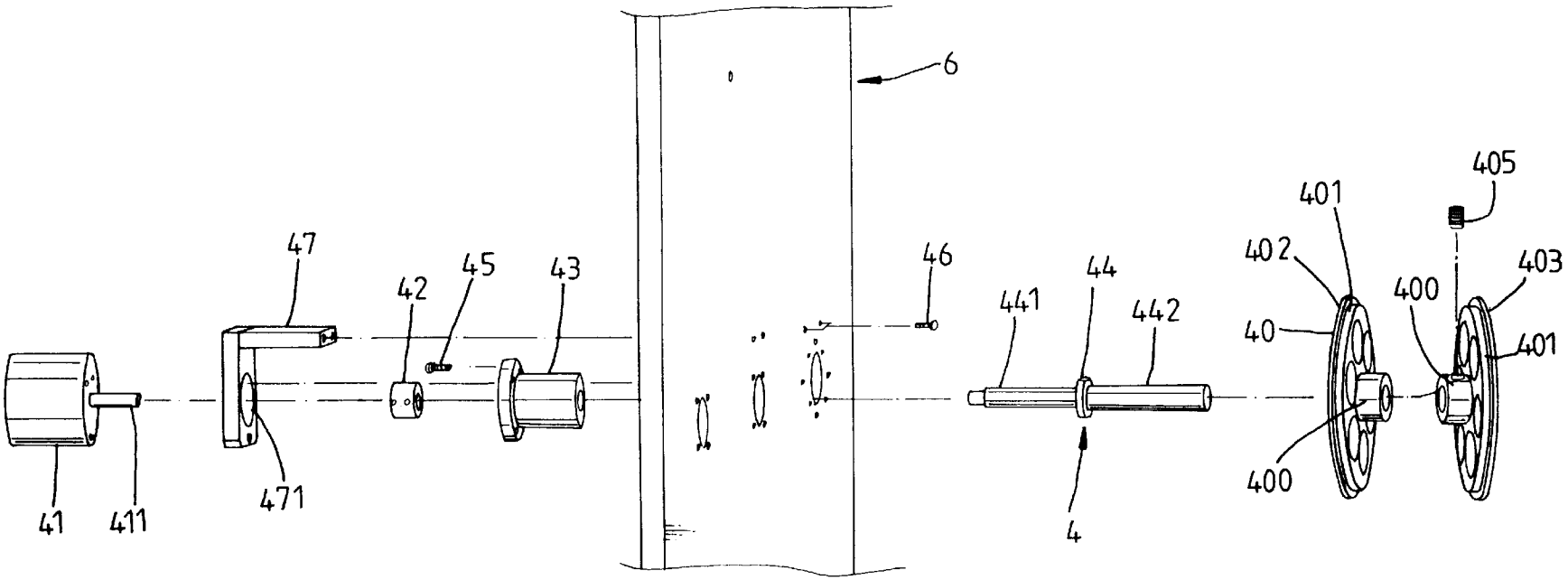
FIG. 4 is an exploded view in an enlarged scale of a part of the present invention, showing the arrangement of the work wheel unit on the rack.

Referring to FIG. 4 and FIG. 1 again, each work wheel unit 4 comprises a work wheel 40, a coupling 42, an axle bearing 43, a wheel axle 44, and a rotary encoder 41. The flexible film tape 7 is extended from the let-off wheel 10 through the idle wheel 50 of one idle wheel unit 5, the tension wheel 30, the work wheel 40 of each work wheel unit 4, and the idle wheel 50 of the other idle wheel unit 5 to the take-up wheel 20. During forward movement of the flexible film tape 7, the friction force between the flexible film tape 7 and the work wheel 40 forces the work wheel 40 to rotate, thereby causing the rotary encoder 41 to rotate with the work wheel 40. The rotary encoder 41 detects the position of the flexible film tape 7, and provides a corresponding signal to the control unit for further examination and circuit exposure control. The axle bearing 43 is fixedly fastened to the rack 6 by fastening means, for example, screws 45. The wheel axle 44 has one end 441 inserted through the axle bearing 43 and coupled to the wheel shaft 411 of the rotary encoder 41 by the coupling 42, and the other end 442 fastened to the work wheel 40. The wheel shaft 411 of the rotary encoder 41 is inserted through an opening 471 of a bracket 47 at the rack 6, and coupled to the wheel axle 44 by the coupling 42.

Referring to FIGS. 1 and 2, the tape take-up wheel unit 2 comprises a motor 21, a coupling 22, an axle bearing 23, a wheel axle 24, and a take-up wheel 20. The motor 21 has an output shaft 211 adapted to rotate the wheel axle 24 and the take-up wheel 20, causing the take-up wheel 20 to take up the flexible film tape 7 from the let-off wheel 10 and a power line 212 connected to the frequency transformer of the control unit, which controls the speed of the motor 21 subject to the speed of the motor 11 of the tape let-off unit 1. The axle bearing 23 is fixedly fastened to the rack 6 by fastening elements, for example, screws 25. The wheel axle 24 has one end 241 inserted through the axle bearing 23 and then coupled to the output shaft 211 of the motor 21 by the coupling 22, and the other end 242 fastened to the take-up wheel 20.

During operation, the idle wheel 50 of each idle wheel unit s guides the flexible film tape 7 from the let-off wheel 10 to the take-up wheel 20, and the tension wheel 30 controls the tension of the flexible film tape 7. When the flexible film tape 7 passing over the shoulder 401 of the work wheel 40 of each work wheel unit 4, the work wheel 40 is forced to rotate, thereby causing the corresponding rotary encoder 41 to rotate synchronously, so that the rotary encoder 41 accurately detect the amount of movement of the flexible film tape 7 and provides a signal indicative of the position of the flexible film tape 7 to the control unit for further examining, scanning, and circuit exposure controls. Further, the shoulder 401 of the work wheel 40 of each work wheel unit 4 forces the flexible film tape 7 to extend out in transverse direction, preventing the flexible film tape 7 from wrinkling.

Further, the idle wheel 50 of each idle wheel unit 5, the tension wheel 30 of the tension control wheel unit 3, and the work wheel 40 of each work wheel unit 4 are respectively comprised of a fixed wheel blade 502, 302 or 402 and an adjustment wheel blade 503, 303 or 403. The fixed wheel blade 502, 302 or 402 and the adjustment wheel blade 503, 303 or 403 each have a wheel shoulder 501, 301 or 401 and a wheel hub 500, 300 or 400. The wheel shoulders 501, 301 or 401 support the flexible film tape 7, keeping the middle part of the flexible film tape 7 suspended above the wheel hubs 500, 300 or 400. Therefore, the wheels 50, 30, and 40 do not touch the circuit area 71 of the flexible film tape 7 during movement of the flexible film tape 7 from the let-off wheel 10 to the take-up wheel 20. The fixed wheel blade 502, 302 or 402 is fixedly fastened to the respective wheel axle 54, 34, or 44. The adjustment wheel blade 503, 303 or 403 is mounted on the respective wheel axle 54, 34, or 44 and fixed in position by a tightening up screw 505, 305, or 405. When loosened the tightening up screw 505, 305, or 405, the adjustment wheel blade 503, 303 or 403 can be moved axially along the respective wheel axle 54, 34, or 44 to adjust the pitch between the fixed wheel blade 502, 302 or 402 and the adjustment wheel blade 503, 303 or 403 subject to the width of the flexible film tape 7 to be delivered.

As indicated above, the invention achieves the following advantages:

1. When delivering the flexible film tape 7 from the let-off wheel 10 to the take-up wheel 20, the shoulders 501, 301, and 401 of the wheels 50, 30, and 40 force the flexible film tape 7 to extend out in transverse direction, preventing the flexible film tape 7 from wrinkling.
2. The transferring system is practical to transfer a flexible film tape, which is partially wrinkled or deformed.
3. The wheels 3, 4, and 5 are so designed that the pitch between the respective fixed wheel blade 302, 402 or 502 and the adjustment wheel blade 303, 403, and 503 is adjustable subject to the width of the flexible film tape to be transferred.
4. The transferring system is practical to transfer flexible film tapes having sprocket holes as well as flexible film tapes without sprocket holes.

A prototype of winding type flexible printed circuit board tape transferring system has been constructed with the features of FIGS. 1~5. The winding type flexible printed circuit board tape transferring system functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A winding type flexible printed circuit board tape transferring system comprising:

a rack;

a tape let-off wheel unit mounted on said rack, said tape let-off wheel unit comprising a let-off wheel controlled to let off a flexible printed circuit board tape;

a tape take-up wheel unit mounted on said rack, said tape take-up wheel unit comprising a take-up wheel controlled to take up the flexible printed circuit board tape from said tape let-off wheel unit;

two idle wheel units respectively mounted on said rack, said idle wheel units each comprising an idle wheel adapted to guide movement of the flexible printed circuit board tape from said tape let-off wheel unit toward said tape take-up wheel unit;

a tension control wheel unit mounted on said rack and arranged between said idle wheel units, said tension control wheel unit comprising a tension wheel- moved to control the tension of the flexible printed circuit board tape being transferred from said tape let-off wheel unit toward said tape take-up wheel unit; and at least one work wheel unit mounted on said rack and arranged between said idle wheel units, said at least one work wheel unit each comprising a work wheel disposed in contact with the flexible printed circuit board tape being transferred from said tape let-off wheel unit toward said tape take-up wheel unit and forced to rotate upon movement of the flexible printed circuit board tape, and a rotary encoder coupled to said work wheel for synchronous rotation with said work wheel to detect the position of the flexible printed circuit board tape being transferred from said tape let-off wheel unit toward said tape take-up wheel unit and to output a signal to a control unit indicative of the position of the flexible printed circuit board tape.

2. The winding type flexible printed circuit board tape transferring system as claimed in claim 1 wherein the idle wheel, tension wheel, and work wheel of each of said idle wheel units, said tension control wheel unit, and each of said at least one work wheel unit each comprise a wheel axle, a fixed wheel blade fixedly fastened to said wheel axle, an adjustment wheel blade mounted on said wheel axle and axially slidably arranged on said wheel axle in parallel to said fixed wheel blade, and a holding down screw adapted to fix said adjustment wheel blade to said wheel axle to fix the pitch between said fixed wheel blade and said adjustment wheel blade, said fixed wheel blade and said adjustment wheel blade each having a shoulder adapted to support the flexible printed circuit board tape being transferred from said let-off wheel to said take-up wheel.

3. The winding type flexible printed circuit board tape transferring system as claimed in claim 2 wherein:

said tape let-off wheel unit further comprises a motor fixedly mounted on said rack and controlled to rotate said let-off wheel, the motor of said tape let-off wheel unit comprising an output shaft, a wheel axle fixedly fastened to said let off wheel, an axle bearing fixedly mounted on said rack and adapted to support the wheel axle being fixedly fastened to said let-off wheel, and a coupling, which couples the wheel axle at said let-off wheel to the output shaft of the motor of said tape let-off wheel unit for enabling motor of said tape let-off wheel unit to rotate said let-off wheel;

said tape take-up wheel unit further comprises a motor fixedly mounted on said rack and controlled to rotate said take-up wheel, the motor of said tape take-up wheel unit comprising an output shaft, a wheel axle fixedly fastened to said take-up wheel, an axle bearing fixedly mounted on said rack and adapted to support the wheel axle being fixedly fastened to said take-up wheel, and a coupling, which couples the wheel axle at said take-up wheel to the output shaft of the motor of said tape take-up wheel unit for enabling motor of said tape take-up wheel unit to rotate said take-up wheel;

said idle wheel units each further comprise an axle bearing fixedly mounted on said rack and adapted to support the wheel axle of the respective idle wheel unit for enabling the idle wheel of the respective idle wheel unit to be rotated upon movement of the flexible printed circuit board tape from said let-off wheel toward said take-up wheel;

said tension control wheel unit further comprises a linear motor fixedly mounted on said rack and adapted to move said tension wheel vertically, said linear motor comprising a vertically extended reciprocating shaft, a vertical track fixedly mounted on said rack, and an axle bearing supporting the wheel axle of said tension wheel on said track and moved with said reciprocating shaft along said vertical track to control the elevational position of said tension wheel;

said at least one work wheel unit each further comprises an axle bearing fixedly mounted on said rack and adapted to support the wheel axle of the work wheel of the respective work wheel unit, and a coupling, which couples the axle wheel of the work wheel of the respective work wheel unit to the rotary encoder of the respective work wheel unit for enabling the work wheel of the respective work wheel unit to rotate the rotary encoder of the respective work wheel unit upon movement of the flexible printed circuit board tape from said let-off wheel toward said take-up wheel.

* * * * *